United States Patent [19]

Loiacono et al.

[11] Patent Number: 5,024,928

[45] Date of Patent: Jun. 18, 1991

[54] SILVER HALIDE MULTILAYER COLOR REVERSAL PHOTOGRAPHIC MATERIAL HAVING IMPROVED COLOR REPRODUCIBILITY

[75] Inventors: Marco Loiacono, Albissola Superiore; Giuseppe Loviglio, Savona, both of Italy

[73] Assignee: Minnesota Mining and Manufacturing Company, St. Paul, Minn.

[21] Appl. No.: 381,098

[22] Filed: Jul. 17, 1989

[30] Foreign Application Priority Data

Jul. 19, 1988 [IT] Italy ..... 21411 A/88

[51] Int. Cl.[5] ..... G03C 1/46

[52] U.S. Cl. ..... 430/504; 430/551; 430/582; 430/583

[58] Field of Search ..... 430/359, 504, 551, 582, 430/583

[56] References Cited

U.S. PATENT DOCUMENTS

| | | | |
|---|---|---|---|
| 3,672,898 | 6/1972 | Schwan et al. | 430/507 |
| 3,728,121 | 4/1973 | Zorn et al. | 430/509 |
| 3,847,613 | 11/1974 | Sakazume et al. | 430/583 |
| 4,518,689 | 5/1985 | Noguchi et al. | 430/574 |
| 4,780,400 | 10/1988 | Beltamini et al. | 430/505 |
| 4,849,327 | 7/1989 | Delprato | 430/551 |

FOREIGN PATENT DOCUMENTS

| | | |
|---|---|---|
| 0108250A1 | 5/1984 | European Pat. Off. . |
| 0228561A1 | 7/1987 | European Pat. Off. . |

*Primary Examiner*—Charles L. Bowers, Jr.
*Assistant Examiner*—Janet C. Baxter
*Attorney, Agent, or Firm*—Gary L. Griswold; Walter N. Kirn; Mark A. Litman

[57] ABSTRACT

A silver halide multilayer color reversal photographic material having improved color reproducibility comprises, in a blue-sensitive silver halide emulsion layer, the combination of a monomethine cyanine spectral sensitizing dye and a thiazole quaternary salt having attached to a quaternary nitrogen atom thereof an alkenyl group having a double bond in the $\beta$-position.

7 Claims, No Drawings

SILVER HALIDE MULTILAYER COLOR REVERSAL PHOTOGRAPHIC MATERIAL HAVING IMPROVED COLOR REPRODUCIBILITY

FIELD OF THE INVENTION

The present invention relates to silver halide multilayer color reversal photographic materials and, more particularly, to silver halide multilayer color reversal photographic materials having improved color reproducibility.

BACKGROUND OF THE INVENTION

Silver halide multilayer color reversal photograph materials usually comprises three silver halide dyeforming units sensitive to blue, green and red light respectively associated with yellow, magenta and cyan dyeforming couplers. Said color reversal materials can be divided into two groups: those which do not contain couplers which are used with a developer containing a diffusible coupler and those which contain couplers wherein non-diffusible couplers are incorporated in each of the light sensitive layers of the light sensitive material. Said materials additionally contain other non-light sensitive layers, such as intermediate layers, filter layers, antihalation layers and protective layers, thus forming a multilayerd structure.

Said color reversal materials, after imagewise exposure, are first processed with a black-and-white developer which develops a silver image in the negative exposed areas. This is followed by a reversal fogging step, a second overall exposure or a chemical fogging step, and then developed with a chromogenic developer to form a positive color image.

In order to obtain excellent color reproducibility, each dye-forming unit of the multilayer color reversal photographic material should independently perform its function during storage, exposure and development. In addition, it is necessary that each dye-forming unit should have spectral absorption located in an appropriate wavelength region and contain color couplers capable of providing color images having appropriate spectral absorption. However, it is known that color reversal photographic materials which have been so far developed possess various defects related to the difficulty to meet these requirements.

A first defect relating to color reproduction is that light absorption of the dye obtained from the couplers is not confined to a desired region of the spectrum and extends to other regions of shorter and longer wavelength, thus causing a reduced color saturation.

A second defect is that, during the step of development processing, the development in one light-sensitive emulsion layer may cause unwanted coloration in a neighboring light-sensitive emulsion layer intended by definition to record another image. For example, image development of the green sensitive layer may cause formation of cyan dye in the red sensitive layer following the pattern of the magenta image. This defect results from the diffusion of the oxidation products of the color developing agent, which are produced by the development of one light-sensitive layer, into a neighboring light-sensitive layer where they cause an unwanted reaction with the couplers present in this layer.

A third defect is that a sensitizing dye may diffuse from a specific light-sensitive emulsion layer in which is used into an adjacent light-sensitive emulsion layer to sensitize the adjacent layer thus providing unsuitable spectral sensitization distribution.

These defects will cause the so called "color mixing" or "color contamination" because the reaction of imagewise color formation in a specific light-sensitive emulsion layer disadvantageously affects the neighboring light-sensitive emulsion layer whereby the latter loses its aptitude to form independent elementary color images and forms images which overlap its specific color images.

Various means have been described in the art to reduce or eliminate said color mixing or contamination defects.

One method is to provide intermediate or filter layers comprising reducing agents such as hydroquinone or phenol derivatives, a scavenger for the oxidation products of color developing agents, a coupler forming colorless compound, color couplers forming diffusible dyes and diffusion inhibiting agents for sensitizing dyes or couplers, such as fine silver halide grains, colloidal silica, anionic, anphoteric, nonionic or cationic surfactants, cationic hydrophilic synthetic polymers, polymer latexes, and the like. However, these methods are not satisfactory.

Other methods for removing color mixing and improving color reproduction consist in using an element having a color correcting function. One such method uses colored couplers provided with an auto-masking function as described in U.S. Pat. No. 2,449,966, 2,455,170, 2,600,606, and 3,148,062 and GB 1,044,778. However, this method cannot be applied to positive color reversal materials because unexposed areas would be strongly colored.

Another method employs DIR-couplers (Development Inhibitor Releasing couplers) such as those couplers described by Barr, Thirtle and Wittum in *Photographic Science and Eng.*, vol. 13, pp. 74-80 and pp. 214–217 (1969) or in U.S. Pat. No. 3,227,554. Generally, the DIR coupler imagewise releases in the light-sensitive emulsion layer in which it is used a development inhibitor bringing about an intralayer (or intraimage) effect and causing an improvement in graininess and an improvement in sharpness of color image by the edge effect. The DIR couplers also bring about an interlayer (or interimage) effect. The development inhibitor released in a layer migrates into an adjacent light-sensitive layer thus providing a color correction effect (interimage effect). However, the method of obtaining interimage effects in color reversal photographic materials using DIR couplers is not satisfactory: the effect of a development inhibitor during the first black-and-white development results in a lower silver density with the development in the color developer of a higher silver density and dye image density. As a consequence, interimage effects are mainly produced in the high dye-density areas of the positive image, while it is desirable to obtain interimage effects in low dye-density areas.

Methods for improving color reproducibility of color reversal photographic materials are described in U.S. Pat. No. 3,672,898 and 3,728,121 and in EP 108,250 and 228,561.

In particular, U.S. Pat. No. 3,672,898 describes a color reversal photographic element containing yellow, magenta and cyan dye forming units, each unit having a relative log spectral sensitivity distribution such that good color rendition is obtained upon exposure under any of a variety of illuminants, such as sunlight, tungsten or fluorescent sources.

U.S. Pat. No. 3,728,121 describes a color reversal photographic material comprising a correcting layer of a fine grain silver halide emulsion incorporated among the light sensitive layers of the material with the purpose of improving the color reproduction.

EP 108,250 discloses a color reversal photographic material comprising blue-sensitive, green-sensitive and red-sensitive silver halide emulsion layers at least one of which forms a group consisting of two or three emulsion layers differing in photographic sensitivity. The emulsion layer group contains silver in its high sensitivity constituent layer or in a combination of its high sensitivity constituent layer and its intermediate sensitivity constituent layer in such an amount that it comprises 40 to 80% of the total silver amount in the emulsion layer group. The emulsion layer group contains silver iodide in its high sensitivity constituent layer or in combination of its high sensitivity constituent layer and its intermediate sensitivity constituent layer in such a content that a proportion of the iodide to the all halides in the high sensitivity constituent layer or in combination of the high sensitivity constituent layer and the intermediate sensitivity constituent layer is smaller than that in its low sensitivity constituent layer by 0.3 :mole % or more. Improvements in blue, red and green saturations are reported.

EP 228,561 discloses a reversal color photographic material comprising image forming units, at least one unit comprising a first silver halide emulsion layer spectrally sensitized to a given region of the spectrum with which is associated a dye image-forming coupler and a second silver halide emulsion layer spectrally sensitized to a different region of the spectrum than the first layer and containing an interimage effect-forming means such as a DIR coupler, which forms either a colorless compound or a dye which does not substantially take part in the formation of the image. Improved interimage effects are reported by releasing a development inhibitor during the color development in an emulsion layer which does not participate in the formation of the image.

The multiplicity of color correction methods indicates that none of them has been fully satisfactory. This is particularly true for yellow color reproduction. Generally, with respect to the spectrally sensitive region of a blue-sensitive emulsion layer, the inherently sensitive region of the silver halide is normally utilized as it is, but the spectral absorption of the silver halides lies near the ultraviolet region and is not suitable for the spectral characteristics of a yellow dye image thus causing poor yellow image reproducibility. To extenuate this problem, the blue-sensitive emulsion layer is spectrally sensitized to impart thereto an absorption characteristic in a longer wavelength region. Merocyanine spectral sensitizing dyes such as:

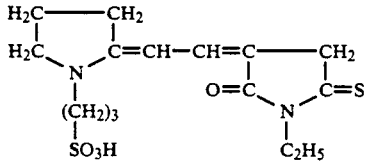

are used to accomplish the above purpose. However, such dyes excessively extends the spectral sensitivity region of the blue-sensitive layer toward the longer wavelength side, thus affording an unwanted spectral sensitization region to said layer and decreasing yellow color reproducibility.

SUMMARY OF THE INVENTION

It has now been found that, in a multilayer color reversal photographic material, the combination in a blue-sensitive silver halide emulsion layer thereof of a monomethine cyanine spectral sensitizing dye and a thiazole quaternary salt compound having attached to a quaternary nitrogen atom thereof an alkenyl group having a double bond in $\beta$-position has the effect of improving yellow color reproducibility.

DETAILED DESCRIPTION OF THE INVENTION

Accordingly, the present invention relates to a silver halide multilayer reversal color photographic material comprising a support base having coated thereon a yellow dye image-forming unit containing at least one blue-sensitive silver halide emulsion layer associated with yellow dye-forming couplers, a magenta dye imageforming unit containing at least one green-sensitive silver halide emulsion layer associated with magenta dye-forming couplers and a cyan dye image-forming unit containing at least one red-sensitive silver halide emulsion layer associated with cyan dye-forming couplers, wherein at least one blue-sensitive silver halide emulsion layer comprises a monomethine cyanine spectral sensitizing dye and a thiazole quaternary salt compound having attached to a quaternary nitrogen atom thereof an alkenyl group having a double bond in $\beta$-position.

The term "dye image-forming unit", as used in the present invention, means one or more layers within a single photographic element, said one or more layers each being spectrally sensitized to a region of the electromagnetic spectrum and each containing a color coupler. Any layers included within a "unit" have similar or same regions of spectral sensitivity and form the same or similar dyes from their respective color couplers upon reaction with an oxidized color photographic developer.

The monomethine cyanine spectral sensitizing dyes for use in the blue-sensitive silver halide emulsion layers according to this invention include, joined by a methine linkage, two basic heterocyclic nuclei, such as those derived from quinolinium, pyridinium, isoquinolinium, 3H-indolium. benzindolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrilium and imidazopyrilium quaternary salts. Preferably monomethine cyanine spectral sensitizing dyes for use in the blue-sensitive silver halide emulsion layers according to this invention are those which exhibit J aggregates if adsorbed on the surface of the silver halide grains and a sharp absorption band (J-band) with a bathocromic shifting with respect to the absorption maximum of the free dye in aqueous solution. Spectral sensitizing dyes producing J aggregates are well known in the art, as illustrated by F. M. Hamer, Cyanine Dyes and Related Compounds, John Wiley and Sons, 1964, Chapter XVII and by T. H. James, The Theory of the Photographic Process, 4the edition, Macmillan, 1977, Chapter 8. The heterocyclic nuclei of the monomethine cyanine dyes preferably include fused benzene rings to enhance J aggregation.

The monomethine cyanine dyes used in the present invention can be represented by the following general formula (I):

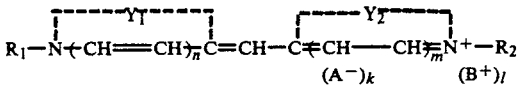

(I)

wherein $Y_1$ and $Y_2$ may be the same or different and each represents the elements necessary to complete a cyclic nucleus derived from basic heterocyclic nitrogen compounds such as oxazoline, oxazole, benzoxazole, the naphthoxazoles (e.g., naphth{2,1-d}oxazole, naphth{2,3-d}oxazole, and naphth{1,2-d}oxazole), thiazoline, thiazole, benzothiazole, the naphthothiazoles (e.g., naphtho{2,1-d}thiazole), the thiazoloquinolines (e.g., thiazolo{4,5-b}quinoline), selenazoline, selenazole, benzoselenazole, the naphthoselenazoles (e.g., naphtho{1,2-d}selenazole, 3H-indole (e.g., 3,3-dimethyl-3H-indole), the benzindoles (e.g., 1,1-dimethylbenzindole), imidazoline, imidazole, benzimidazole, the naphthimidazoles (e.g., naphth{2,3-d}imidazole), pyridine, and quinoline, which nuclei may be substituted on the ring by one or more of a wide variety of substituents such as hydroxy, the halogens (e.g., fluoro, bromo, chloro, and iodo), alkyl groups or substituted alkyl groups (e.g., methyl, ethyl, propyl, isopropyl, butyl, octyl, dodecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., ethylthio and methylthio), arylthio groups (e.g., phenylthio, p-tolythio, and 2-naphthylthio), methylenedioxy, cyano, 2-thienyl, styryl, amino or substituted amino groups (e.g., anilino, dimethylanilino, diethylanilino, and morpholino), acyl groups (e.g., acetyl and benzoyl), and sulfo groups, $R_1$ and $R_2$ can be the same or different and represent alkyl groups (including alkenyl and alkinyl groups), aryl groups or aralkyl groups, with or without substituents, (e.g., carboxymethyl, 2-hydroxyethyl, 3-sulfopropyl, 3-sulfobutyl, 4-sulfobutyl, 2-methoxyethyl, 2-sulfatoethyl, 3-thiosulfatoethyl, 2-phosphonoethyl, chlorophenyl, and bromophenyl), n and m are 0 or 1, except that both n and m preferably are not 1, A is an anionic group, B is a cationic group, and k and 1 may be 0 or 1, depending on whether ionic substituents are present. Variants are, of course, possible in which $R_1$ and $R_2$ (particularly when n and m are 0) together represent the atoms necessary to complete an alkylene bridge.

In the most preferred form of this invention, the monomethine cyanine dyes used in the present invention are represented by the following general formula (II):

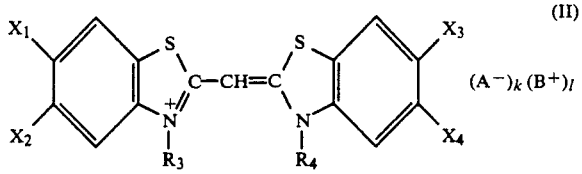

(II)

wherein $X_1$, $X_2$, $X_3$ and $X_4$ each represents a hydrogen atom, a halogen atom (e.g. chloro, bromo, iodo, and fluoro), a hydroxy group, an alkoxy group (e.g. methoxy and ethoxy), an amino group (e.g. amino, methylamino, and dimethylamino), an acylamino group (e.g. acetamido and propionamido), an acyloxy group (e.g. acetoxy group), an alkoxycarbonyl group (e.g. methoxycarbonyl, ethoxycarbonyl, and butoxycarbonyl), an alkyl group (e.g. methyl, ethyl, and isopropyl), an alkoxycarbonylamino group (e.g. ethoxycarbonylamino) or an aryl group (e.g. phenyl and tolyl), or, together, $X_1$ and $X_2$ and, respectively, $X_3$ and $X_4$ can be the atoms necessary to complete a benzene ring (so that the heterocyclic nucleus results to be, for example, an $\alpha$-naphthoxazole nucleus, a $\beta$-naphthoxazole or a $\beta,\beta'$-naphthoxazole), $R_3$ and $R_4$ each represents an alkyl group (e.g. methyl, propyl, and butyl), a hydroxyalkyl group (e.g. 2-hydroxyethyl, 3-hydroxypropyl, and 4-hydroxybutyl), an acetoxyalkyl group (e.g. 2-acetoxyethyl and 4-acetoxybutyl), an alkoxyalkyl group (e.g. 2-methoxyethyl and 3-methoxypropyl), a carboxyl group containing alkyl group (e.g. carboxymethyl, 2-carboxyethyl, 4-carboxybutyl, and 2-(2-carboxyethoxy)-ethyl), a sulfo group containing alkyl group (e.g. 2-sulfoethyl, 3-sulfopropyl, 4- sulfobutyl, 2-hydroxy3- sulfopropyl, 2-(3-sulfopropoxy)-propyl, p-sulfobenzyl, and p-sulfophenethyl), a benzyl group, a phenetyl group, a vinylmethyl group, and the like, A, B, k and 1 have the same meaning as above.

The alkyl groups included in said substituents $X_1$, $X_1$, $X_2$, $X_3$, X $R_3$, and $R_4$ and, more particularly, the alkyl portions of said alkoxy, alkoxycarbonyl, alkoxycarbonylamino, hydroxyalkyl, acetoxyalkyl groups and of the alkyl groups associated with a carboxy or sulfo group each preferably contain from 1 to 12, more preferably from 1 to 4 carbon atoms, the total number of carbon atoms included in said groups preferably being no more than 20.

The aryl groups included in said substituents $X_1$, $X_1$, $X_2$, $X_3$ and $X_4$ each preferably contain from 6 to 18, more preferably from 6 to 10 carbon atoms, the total number of carbon atoms included in said groups arriving up to 20 carbon atoms.

The following are specific examples of monomethine cyanine spectral sensitizing dyes belonging to those represented by the general formulas (I) and (II) above:

1.

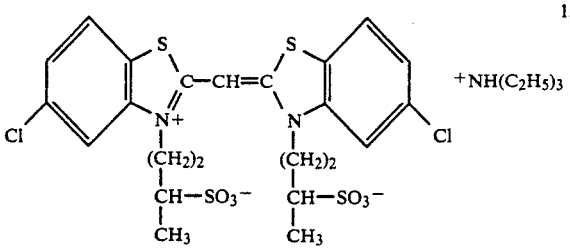

2.

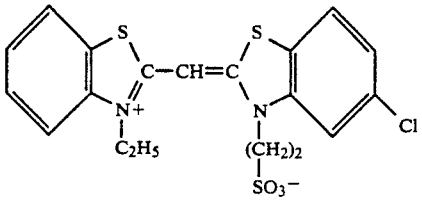

3.

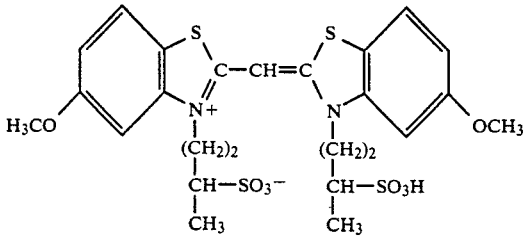

4.

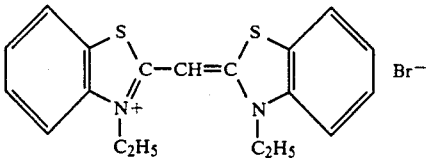

5.

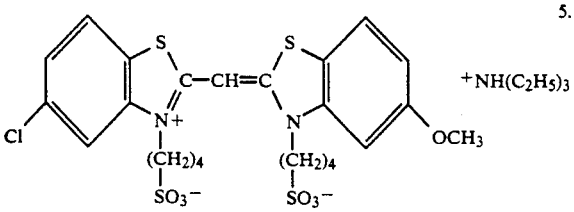

6.

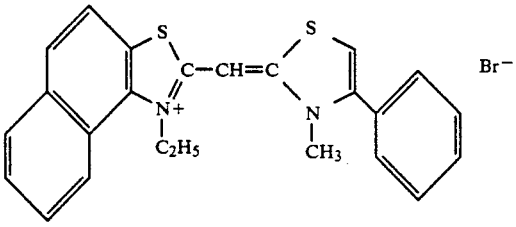

7.

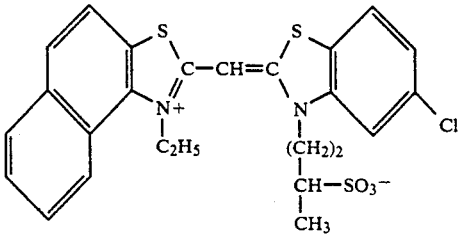

-continued

8.

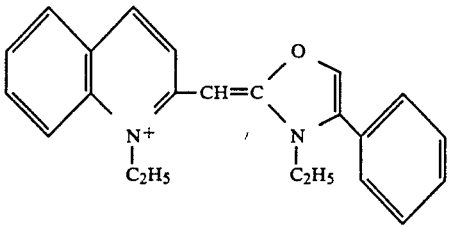

The thiazole quaternary salt compounds for use in the blue-sensitive silver halide emulsion layers inn combination with the monomethine cyanine sensitizing dyes according to this invention include thiazole, benzothiazole, naphthothiazole and benzo-bis-thiazole quaternary salt compounds. Said thiazole quaternary salt compounds can be represented by the general formula (III)

(III)

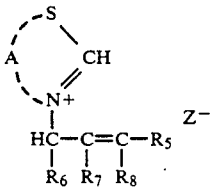

wherein $R_5$, $R_6$, $R_7$ and $R_8$ each represents a hydrogen atom or a lower alkyl group, A represents the atoms necessary to complete a thiazole, benzothiazole, naphthothiazole or benzo-bis-thiazole nucleus and $Z^-$is an anion.

Lower alkyl groups represented by $R_5$, $R_6$, $R_7$ and $R_8$ have from 1 to 5 carbon atoms; suitable lower alkyl groups are a methyl group, an ethyl group, a propyl group, an iso-propyl group, a butyl group, an iso-butyl group, a tertiary-butyl group, a normal pentyl group or a tertiary amyl group. The total carbon atoms of the lower alkyl groups represented by $R_5$, $R_6$, $R_7$ and $R_8$, when more than one group is present, is such not to negatively affect the properties of the thiazole quaternary salt compounds of this invention. The lower alkyl groups represented by R $R_6$, $R_7$ and $R_8$ may have up to a maximum of 20 carbon atoms. Preferably, said total number of carbon atoms of R R , R7 and R8 is less than 15, more preferably less than 5.

$Z^-$of the formula (III) above may represent an acid anion (e.g. chloride, bromide, iodide, thiocyanate, methylsulfate, ethylsulfate, perchlorate, p-toluensulfonate ions or other well-known photographically inert or harmless anions).

Preferably, the thiazole quaternary salt compounds can be represented by the general formula (IV)

(IV)

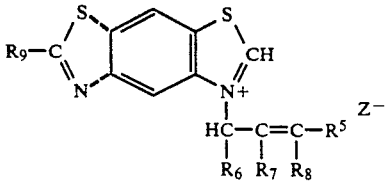

wherein $R_5$, $R_6$, $R_7$, $R_8$ and $Z^-$are the same as above and $R_9$ represents a hydrogen atom or a lower alkyl group.

The lower alkyl group represented by R9 has from 1 to 5 carbon atoms; suitable lower alkyl groups are a methyl, ethyl, propyl, iso-propyl, butyl, iso-butyl, tertiary butyl, normal pentyl or tertiary amyl group, preferably a methyl group.

In the previous formula (IV) the non-quaternized thiazole group may be fused to the benzene ring by linking the nitrogen atom and the sulphur atom to the positions 3, 4, 5 or 6 of the benzene ring. By this way, the nitrogen atom may be linked to the 3-position and the sulphur atom to the 4-position of the benzene ring or viceversa (thus obtaining a benzo(1,2-d:4,3--d')-bis-thiazole quaternary salt or a benzo-(1,2-d:3,4-d')-bis-thiazole quaternary salt, respectively), or the nitrogen atom may be linked to the 4-position and the sulphur atom to the 5-position of the benzene ring or viceversa (thus obtaining a benzo(1,2-d:5,4-d')-bis-thiazole quaternary salt or a benzo-(1,2-d:4,5-d')-bis-thiazole quaternary salt, respectively), or the nitrogen atom may be linked to the 5-position and the sulphur atom to the 6-position of the benzene ring or viceversa (thus obtaining a benzo(1,2-d:6,5-d')-bisthiazole quaternary salt or a benzo-(1,2-d:5,6-d')-bisthiazole quaternary salt, respectively).

Typical examples of N-alkenyl thiazolium salt compounds for use in the present invention are described in EP 250,740. Typical examples of N-alkenyl benzo- or naphthothiazolium salt compounds for use in the present invention are described in U.S. Pat. No. 3,954,478. Typical examples of N-alkenyl benzo-bis-thiazolium salt compounds include the following:

(1)

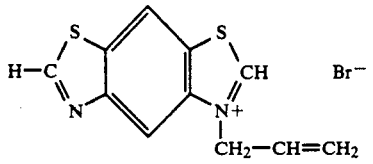

(2)

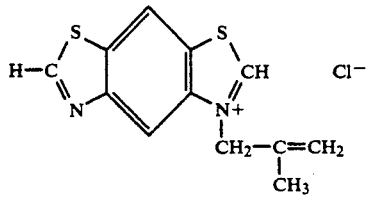

(3)

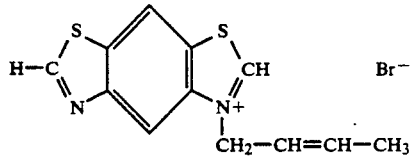

(4)

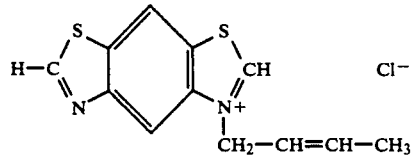

-continued (5)

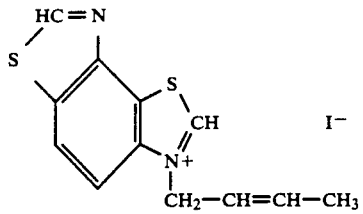

(6)

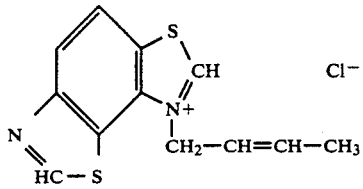

(7)

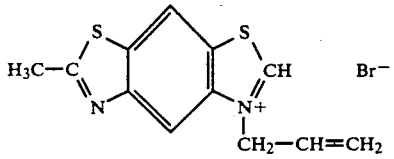

The monomethine cyanine spectral sensitizing dyes and the thiazole quaternary salt compounds may be incorporated in any blue-sensitive silver halide emulsion layer of the multilayer color reversal material according to the present invention. They may be incorporated into any blue-sensitive silver halide emulsion layer during any step of the preparation of the photographic material. They may e added during the emulsion making, the physical ripening, before or after the chemical ripening and before or during the coating process, as known in the art. The monomethine cyanine spectral sensitizing dyes spectral sensitize the silver halide emulsion in the spectral sensitivity range of from 440 to 480 nm and are preferably incorporated in an amount of from 0.1 to 0.3 g. per mole of silver halide. If said monomethine cyanine dyes are incorporated in an amount within said range, an increase in spectral sensitivity occurs in the above wavelength range with a sharp J band at about 465 nm without extending the spectral sensitivity region toward the longer wavelength side and consequently improving yellow color reproducibility. If the monomethine cyanine dyes are incorporated in an amount exceeding said range, a decrease in spectral sensitivity in the above wavelength range and a corresponding decrease of the relative sensitivity to blue light occur. The thiazole quaternary salt compounds do not modify the spectral absorption of the blue-sensitive silver halide emulsion layers into which they are incorporated. Surprisingly, said thiazole quaternary salt compounds improve the yellow color reproducibility, the combination of said monomethine cyanine spectral sensitizing dyes and said thiazole quaternary salt compounds resulting in an improvement of the yellow color reproducibility which cannot be obtained with the single components of the combination used separately. Said thiazole quaternary salt compounds are preferably incorporated in an amount of from 0.1 to 0.4 g. per mole of silver halide.

The multilayer color reversal photographic materials of the present invention are preferably multilayer color reversal photographic materials comprising a blue sensitized silver halide emulsion layer associated with Yellow dye-forming color couplers, a green sensitized silver halide emulsion layer associated with magenta dye-forming color couplers and a red sensitized silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 um. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an $\alpha$-naphthol compound, is associated with red-sensitive silver halide emulsion layers, at least one non-diffusible magenta image-forming color coupler, generally a 5-pyrazolone or a pyrazolotriazole compound, is associated with greensensitive silver halide emulsion layers and at least one non-diffusible yellow image forming color coupler, generally a acylacetanilide compound, is associated with blue-sensitive silver halide emulsion layers.

Said color couplers may be both 4-equivalent and 2-equivalent couplers, the latter requiring a smaller amount of silver halide for color production. As known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include the known white couplers which do not form any dye on reaction with the color developer oxidation products. The 2-equivalent color couplers include also the known DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

Examples of magenta couplers which can be used in the present invention can be selected from those described in U.S. Pat. Nos. 2,600,788; 3,558,319; 3,468,666; 3,419,301; 3,311,476; 3,253,924 and 3,311,476 and in British patents 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications 1,956,281, 2,162,899 and 2,213,461 and in British Patents 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British patent 1,464,361.

Colorless couplers which can be used in the present invention can be selected from those described in British patents 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications S.N. 2,414,006; 2,659,417; 2,527,652; 2,703,145 and 2,626,315; in Japanese patent applications S.N. 30,591/75 and 82,423/77 and in British patent 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75 and in British patents 1,423,588 and 1,542,705.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromochloride containing 1 to 12% mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 5 $\mu$m. The silver halide emulsion can be prepared using a single-jet method, a double-jet method, or a combination of these methods or can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic material can contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halide contained in the photographic materials of the present invention after exposure can be processed to form a visible image by associating the silver halide with an aqueous alkaline medium in the presence of a developing agent contained in the medium or in the material. Processing formulations and techniques are described in Research Disclosure 17643, XIX, XX and XXI, December 1978. The following examples are described for a better understanding of this invention.

EXAMPLE 1

A multilayer light sensitive color reversal element (Film A: comparative example) composed of layers having the following composition coated on a cellulose triacetate film support was prepared.

The lst layer: Antihalation layer. A gelatin layer containing black colloidal silver at a silver coating ight of 0.2 g/m$^2$. we The 2nd layer: Red sensitive low sensitivity emulsion layer. A gelatin layer comprising a silver bromoiodide emulsion (silver iodide: 5% by mol; average grain size: 0.3 μm) at a silver coating weight of 0.53 g/m$^2$ and a silver/gelatin ratio of 0.25, Sensitizing dye I in amount of 0.0000594 grams per mol of silver, Sensitizing dye II in amount of 0.000306 grams per mol of silver, Coupler A in an amount of 0.229 mol per mol of silver dispersed in tricresylphosphate and diethyllauramide.

The 3rd layer: Red sensitive high sensitivity emulsion layer. A gelatin layer comprising a silver bromoiodide emulsion (silver iodide: 7% by mol; average grain size: 0.65 μm) at a silver coating weight of 0.70g/m$^2$ and a silver/gelatin ratio of 0.39, Sensitizing dye I in amount of 0.0586 grams per mol of silver, Sensitizing dye II in an amount of 0.1789 grams per mol of silver, Coupler A in an amount of 0.197 mol per mol of silver dispersed in tricresylphosphate and diethyllauramide.

The 4th layer: Intermediate layer. A gelatin layer comprising 2,5-ditert.-octylhydroquinone dispersed in tricresylphosphate.

The 5th layer: Green sensitive low sensitivity emulsion layer. A gelatin layer comprising a silver bromoiodide emulsion (silver iodide: 5% by mol; average grain size: 0.3 μm) at a total silver coating weight of 0.77 g/m$^2$ and a total silver/gelatin ratio of 0.339, Sensitizing dye III in an amount of 0.000622 mol per mol of silver, Sensitizing dye IV in an amount of 0.000130 mol per mol of silver and Coupler B in an amount of 0.1366 mol per mol of silver.

The 6th layer: Green sensitive high sensitivity emulsion layer. A gelatin layer comprising a silver bromoiodide emulsion (silver iodide: 7% by mol; average grain size: 0.65 μm) at a silver coating weight of 0.62 g/m$^2$ and a silver/gelatin ratio of 0.5, Sensitizing dye III in an amount of 0.000508 mol per mol of silver, Sensitizing dye IV in an amount of 0.000116 mol per mol of silver, Coupler B in an amount of 0.161 mol per mol of silver.

The 7th layer: Intermediate layer. The same as the 4th layer.

The 8th layer: Yellow filter layer. A gelatin layer comprising dispersed yellow colloidal silver.

The 9th layer: Blue sensitive low sensitivity emulsion layer. A gelatin layer comprising a silver bromoiodide emulsion (silver iodide: 5% by mol; average grain size: 0.3 μm) at a silver coating weight of 0.81 g/m$^2$ and a silver/gelatin ratio of 0.393, Coupler C in an amount of 0.110 mol per mol of silver and Coupler D in an amount of 0.0536 mol per mol of silver both dispersed in tricresylphcsphate and diethyllauramide.

The 10th layer: Blue sensitive high sensitivity emulsion layer. A gelatin layer comprising a silver bromoiodide emulsion (silver iodide: 7% by mol; average grain size: 0.65 μm) at a silver coating weight of 0.84 g/m$^2$ and a silver/gelatin ratio of 0.418, Coupler C in an amount of 0.138 mol per mol of silver and Coupler D in an amount of 0.067 mol per mol of silver both dispersed in tricresylphosphate and diethylalauramide.

The 11th layer: Intermediate layer. A gelatin layer comprising gelatin at a coating weight of 0.88 g/m$^2$, 2-(2'-hydroxy-3',5''-di-t-butylphenyl)-5-t-butyl-benzotriazole UV absorber dispersed in tricresylphosphate and dibutylphthalate and diallylaminoallylidenemalononitrile UV-blue dye.

The 12th layer: Protective layer. A gelatin layer comprising gelatin at coating weight of 0.68 g/m$^2$.

Gelatin hardeners, surface active agents, antifogging and stabilizing agents were in addition added to the layers.

A second multilayer light sensitive color reversal element (Film B: example according to this invention) was prepared by following the same procedure as in Film A, except that the 9th blue sensitive low sensitivity layer comprised the monomethincyanine Dye 1 in an amount corresponding to 190 mg per mole of silver and the thiazole quaternary salt Compound 1 in an amount corresponding to 190 mg per mole of silver and 10th blue sensitive high sensitivity layer comprised the monomethincyanine Dye 1 in an amount corresponding to 190 mg per mole of silver and the thiazole quaternary salt Compound 1 in an amount corresponding to 180 mg per mole of silver.

Samples of the two elements were given identical sensitometric stepped exposures at 5,5000° K. light for 1/20''(neutral exposure $E_N$). Other samples of the two elements were given the same exposure with the interposition of a Kodak Wratten$^R$ W12 filter which transmits only light from 500 nm to red (filter exposure $E_{W12}$ Exposed samples were processed through the reversal color process E6 described in "Using Process E6, Kodak Publication N2-119".

Using blue, green and red transmission densities determined according the American Standard PH 2,1-1952 the characteristic curves of the three image-forming unities were plotted.

The difference in blue sensitivity δ logE of the yellow dye forming unit, in green sensitivity δ log E of the magenta dye forming unit and in red sensitivity δ''logE of the cyan dye forming unit were determined according to $$\delta logE = logE_{BN} - \log E_{BW12}$$

$\delta' logE = logE_{GN} - logE_{GW12}$ $\delta'' logE = logE_{RN} - logE_{RW12}$ wherein $logE_{BN}$, $logE_{GN}$ and $logE_{RN}$ are respective sensitivities of blue, green and red sensitive layers upon neutral exposure, and $logE_{BW12}$, $logE_{GW12}$ and $logE_{RW12}$ are respective sensitivities of blue, green and red sensitive layers upon filter exposure (sensitivities are measured at an absolute density of 1.0). The greater is δ logE the better are color reproducibility and saturation of the considered material. δ'logE and δ''logE measure the unwanted spectral absorption affecting the blue from the green and the red. In the present invention they are very low compared to a high value of −δ logE . The values of −δ logE, −δ'logE and -logE are reported in the following Table 1. The Table 1 reports also the relative sensitivity of the yellow dye forming unit taking 100 as the sensitivity of the reference Film A.

TABLE 1

| Film | −δ logE | −δ' logE | −δ'' logE | Rel. Sens. |
|---|---|---|---|---|
| A (Compar. ex.) | 1.82 | 0.22 | 0.10 | 100 |
| B (Pres. invent.) | 2.59 | 0.20 | 0.09 | 177 |

Compounds used for preparing films A and B are the following.

Sensitizing Dye I: 5,6-dimethyl-5'-bromo-9-ethyl-3-ethyl-3'-carbonxyethyl-thiacarbocyanine iodide.

Sensitizing Dye II: 5-methoxy-5'-methyl-6'-methoxy-9-ethyl-3-ethyl-3'-carboxyethyl -selenathiacarbocyanine iodide.

Coupler A: 2-trifluoroacctamido-4-chloro-5-{-(2',4'-di-tert.-amylphenoxy)-butyramido}-phenol.

Sensitizing Dye III: Anhydro-5-chloro-5'-phenyl-9-ethyl-3-sulfopropyl-3'(α-methyl)-sulfopropyl-oxacarbocyanine hydroxide sodium salt.

Sensitizing DYe IV: Anhydro-5,5',6,6'-tetrachloro-1,1'-diethyl-3,3'-di(α-methyl)-sulfopropyl-benzimidazolo Carbocyanine hydroxide.

Coupler B: 1-(2',4',6'-trichlorophenyl)-3-[3''-α2'''4''-ditert.-amylphenoxy-butyramido)-benzamido]-5-pyrazolone. (3-chloro-1,2,4-triazol-1-yl)-5Coupler Coupler C: α-pivalyl-α(3-chloro-1,2,4-triazol-1-yll)-5-[-(2,4-ditert.-amylphenoxy)-butyramido]-2-chloro-acetanilide. Coupler D: α-(2-otadecyloxybenzoyl)-2-chloro-4-phenylaminosulfonyl-acetanilide.

EXAMPLE 2

Seven multilayer light sensitive color reversal elements (Films C to I) were prepared by following the same procedure as in Film A of example 1, except that the 9th blue sensitive high sensitivity layer and 10th blue sensitive high sensitivity layer comprised the monomethincyanine Dye 1 and the thiazole quaternary salt Compound 1 in various amounts per mole of silver as reported in the following Table 2. The difference in sensitivity −δlogE of the yellow dye forming unit comprising the 9th and 10th blue sensitive layers and the sensitivity of the same unit relative to the sensitivity of Film A are reported in the same Table.

TABLE 2

| | Dye 1 mg/mole Ag | | Compound 1 mg/mole Ag | | | |
|---|---|---|---|---|---|---|
| Film | 9th | 10th | 9th | 10th | −δ logE | Rel. Sens. |
| C | 95 | 95 | 190 | 180 | 2.45 | 163 |
| D | 285 | 285 | 190 | 180 | 2.61 | 179 |
| E | 285 | 285 | 380 | 360 | 2.54 | 172 |
| F | 95 | 95 | 380 | 360 | 2.43 | 161 |
| G | 285 | 285 | 285 | 270 | 2.58 | 176 |
| H | 190 | 190 | 0 | 0 | 2.34 | 152 |
| I | 0 | 0 | 190 | 180 | 2.34 | 152 |

EXAMPLE 3

Two multilayer light sensitive color reversal elements (Films L and M) were prepared by following the same procedure as in Film A of example 1. Film L comprised in the 9th blue sensitive low sensitivity layer and in the 10th blue sensitive high sensitivity layer 0.9 and, respectively, 0.6 grams per mole of silver of the blue spectral sensitizing Dye V. Film M comprised in the 9th blue sensitive low sensitivity layer and in the 10th blue sensitive high sensitivity layer 0.9 and, respectively, 0.6 grams per mole of silver of the blue spectral sensitizing merocyanine Dye V and 190 and, respectively, 180 mg of the thiazole quaternary salt Compound 1. The sensitivity of the yellow forming unit relative to the sensitivity of Film A of example 1 and Film H of example 2 are reported in the Table 3 together with the evaluation of the appearance of a J band.

TABLE 3

| Film | Rel. Sens. | J band |
|---|---|---|
| A | 100 | no |
| B | 177 | yes* |
| L | 111 | no |
| M | 132 | no |
| H | 152 | yes* |

*J band at 465 nm

Sensitizing Dye V:

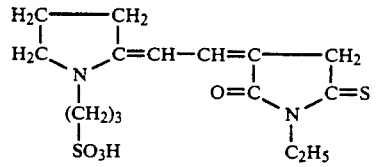

We claim:

1. A silver halide color reversal multilayer photographic material comprising a support base having thereon a yellow dye image-forming unit containing at least one blue-sensitive silver halide emulsion layer associated with a yellow dye-forming coupler, a magenta dye image-forming unit containing at least one green-sensitive silver halide emulsion layer associated with a magenta dye-forming coupler and a cyan dye image-forming unit containing at least one red-sensitive silver halide emulsion layer associated with a cyan dye-forming coupler, characterized in that said at least one blue-sensitive silver halide emulsion layer comprises a monomethine cyanine spectral sensitizing dye and a thiazole quaternary salt compound having attached to a quaternary nitrogen atom thereof an alkenyl group having a double bond in β-position, said salt compound improving the color reproducibility of the yellow dye and said thiazole quaternary salt compound is represented by the general formula (IV)

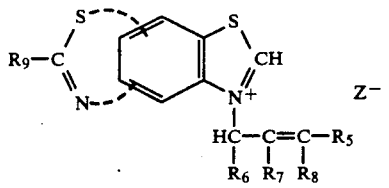

wherein $R_5$, $R_6$, $R_7$, $R_8$ and $R_9$ each represents a hydrogen atom or a lower alkyl group and Z is an anion.

2. A silver halide multilayer reversal color photographic material as claimed in claim 1, wherein each silver halide emulsion is a negative-acting emulsion.

3. A silver halide multilayer reversal color photographic material as claimed in claim 1, wherein each silver halide emulsion is a silver bromoiodide emulsion.

4. A silver halide multilayer reversal color photographic material as claimed in claim 1, wherein said monomethine cyanine spectral sensitizing dye is present in the silver halide emulsion layer in an amount ranging from 0.1 to 0.3 grams per mole of silver.

5. A silver halide multilayer reversal color photographic material as claimed in claim 1, wherein said thiazole quaternary salt compound is present in the silver halide emulsion layer in an amount ranging from 0.2 to 0.4 grams per mole of silver.

6. A silver halide multilayer reversal color photographic material as claimed in claim 1, wherein the yellow dye image-forming unit is comprised of a plurality of blue-sensitive silver halide layers of different sensitivity.

7. A silver halide multilayer reversal color photographic material as claimed in clam 1, wherein the yellow dye image-forming unit is comprised of a high sensitivity silver halide emulsion layer and a low sensitivity silver halide emulsion layer.

* * * * *

UNITED STATES PATENT AND TRADEMARK OFFICE

CERTIFICATE OF CORRECTION

PATENT NO. : 5,024,928

DATED : June 18, 1991

INVENTOR(S) : Loiacono et al.

It is certified that error appears in the above-identified patent and that said Letters Patent is hereby corrected as shown below:

Col. 8, line 44, Replace "R" with --$R_5$--

Col. 8, line 46, Replace "R R" with --$R_5$, $R_6$--

Col. 13, line 31, Replace "ight" with --weight--

Signed and Sealed this

Second Day of November, 1993

Bruce Lehman

BRUCE LEHMAN

*Commissioner of Patents and Trademarks*

*Attest:*

*Attesting Officer*